US006082323A

United States Patent [19]

Winberg

[11] Patent Number: 6,082,323

[45] Date of Patent: Jul. 4, 2000

[54] FUEL SHUTOFF SYSTEM

[75] Inventor: James R. Winberg, Brookfield, Wis.

[73] Assignee: Briggs & Stratton Corporation, Wauwatosa, Wis.

[21] Appl. No.: 09/225,796

[22] Filed: Jan. 5, 1999

Related U.S. Application Data

[62] Division of application No. 08/780,338, Jan. 8, 1997.

[51] Int. Cl.[7] ..... F02B 77/00

[52] U.S. Cl. ..... 123/198 DB; 123/198 DC

[58] Field of Search ..... 123/DIG. 11, 198 DC, 123/198 DB

[56] References Cited

U.S. PATENT DOCUMENTS

| | | | |
|---|---|---|---|
| 3,897,771 | 8/1975 | Stumpp | 123/198 DB |
| 4,050,436 | 9/1977 | Crabtree | 123/198 DB |
| 4,077,381 | 3/1978 | Firey | 123/179 G |
| 4,078,536 | 3/1978 | Ozawa et al. | 123/198 DB |
| 4,111,175 | 9/1978 | Nakamura et al. | 123/198 DC |
| 4,111,176 | 9/1978 | Fenton et al. | 123/198 DB |
| 4,161,639 | 7/1979 | Nofel | 200/157 |
| 4,198,816 | 4/1980 | Hasegawa et al. | 60/305 |
| 4,414,162 | 11/1983 | Ii et al. | 261/23 A |
| 4,510,739 | 4/1985 | Dluhosch | 56/17.5 |
| 4,924,827 | 5/1990 | Minegishi | 123/198 DB |
| 5,050,548 | 9/1991 | Minegishi | 123/198 D |
| 5,092,295 | 3/1992 | Kobayashi | 123/198 DC |
| 5,301,644 | 4/1994 | Olmr | 123/198 DB |
| 5,357,935 | 10/1994 | Oxley et al. | 123/527 |
| 5,445,121 | 8/1995 | Kai | 123/198 DC |

*Primary Examiner*—John Kwon
*Attorney, Agent, or Firm*—Michael Best & Friedrich LLP

[57] ABSTRACT

A fuel shutoff system that is usable on engines without a battery, and is inexpensive to manufacture. The fuel shutoff system operates without interfering with the engine governor, and effectively blocks the fuel flow downstream of the fuel bowl upon engine shutdown. The invention is a fuel shutoff system for an internal combustion engine, wherein the engine has a carburetor with a fuel bowl and a fuel nozzle, an intake valve, and a fuel conduit between the fuel bowl and the intake valve. The engine also includes a gas passageway through which a gas may pass to an intake valve of the engine. The engine has a throttle valve disposed in the passageway, and the blocking apparatus is distinct from the throttle valve. The invention includes a blocking member disposed in the gas passageway. A lever is used for selectively positioning the blocking member in a first open position, and in a second closed position upon engine shutdown to substantially block the flow of gas or fuel/air mixture to the intake valve and to the combustion chamber. Another aspect of the invention is a circuit that grounds an ignition system of the engine wherein the fuel shutoff system and the grounding circuit are both actuated by operation of the manually-operable control.

28 Claims, 7 Drawing Sheets

52
67
70
68
66
74
72
64
60b
60a
59
60c
60
58
56
54
46b
49
46
44b
50
44
42b
42
34
40
34a
22
43
46a
42a
45
23
48
46
44a
44
42

Fig. 5
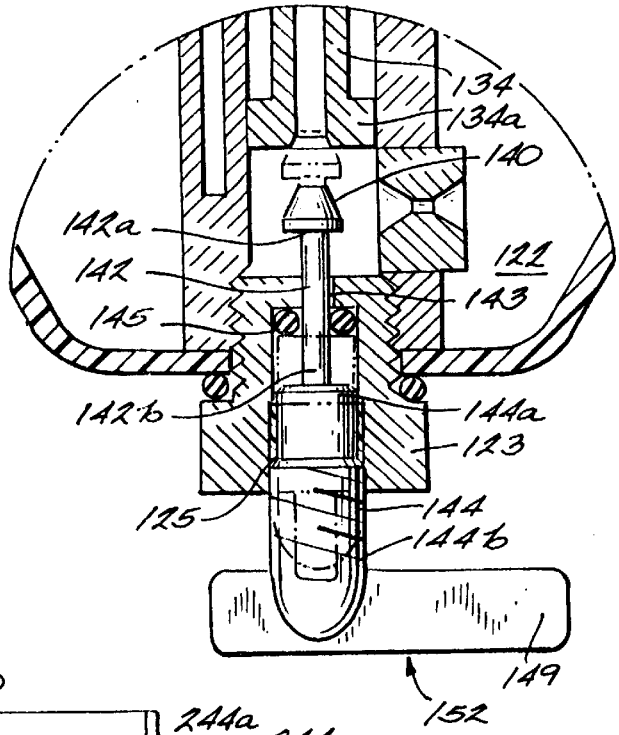
Fig. 6
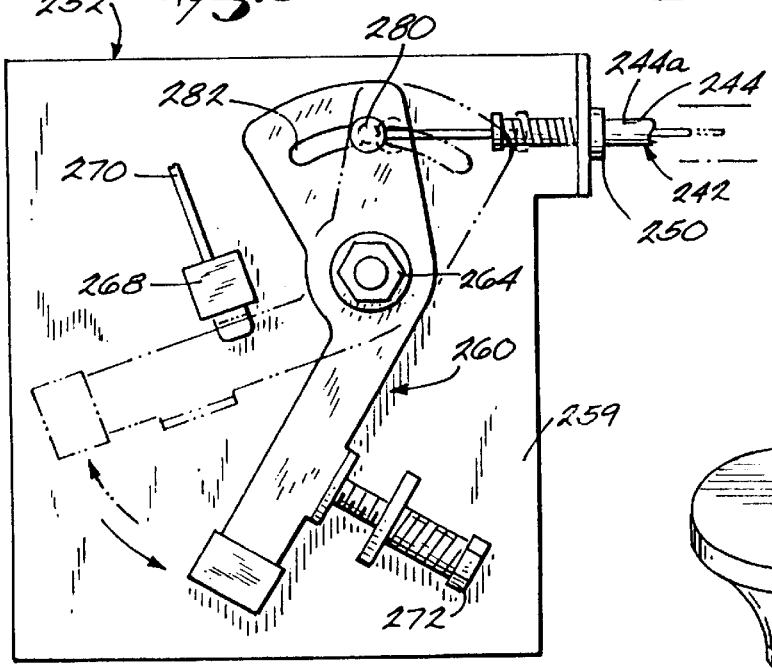
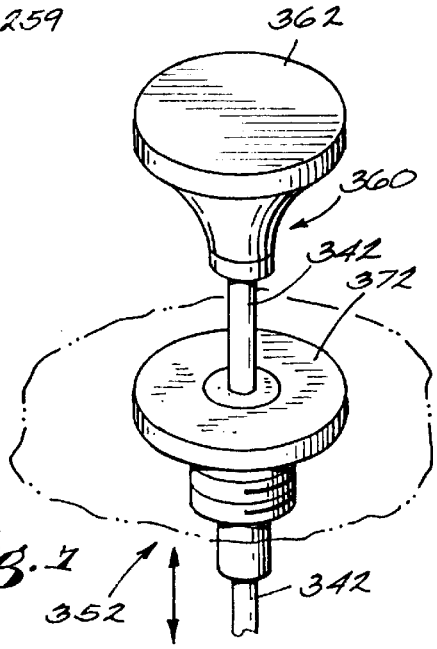
Fig. 7

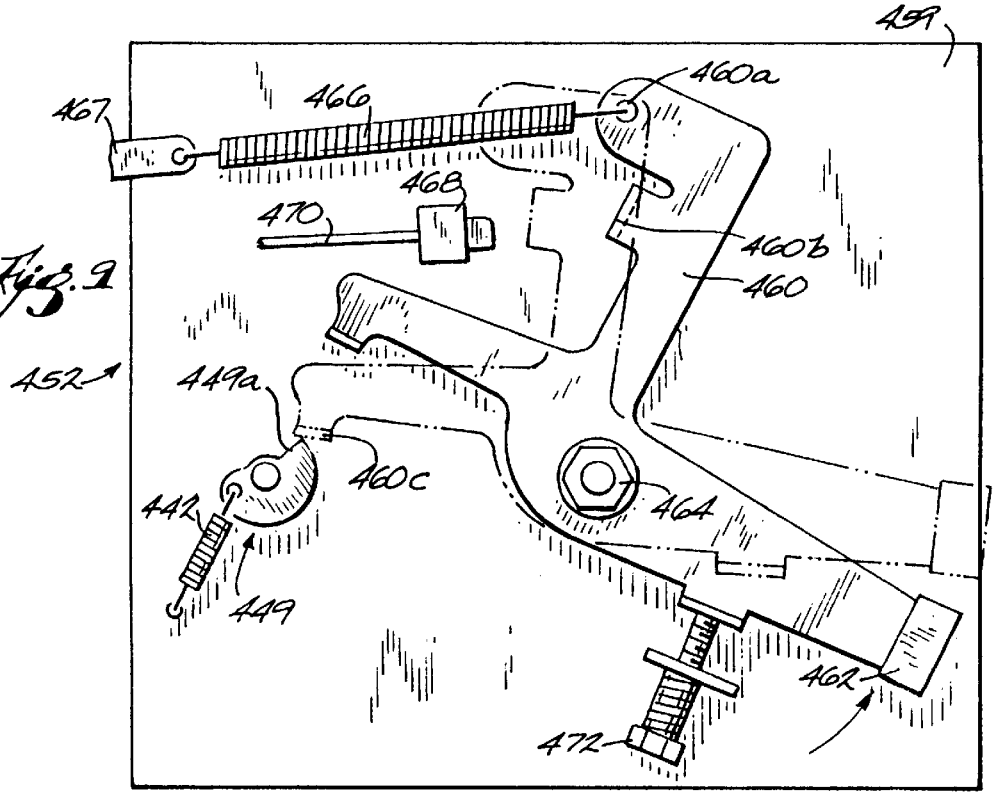
Fig. 9
Fig. 10
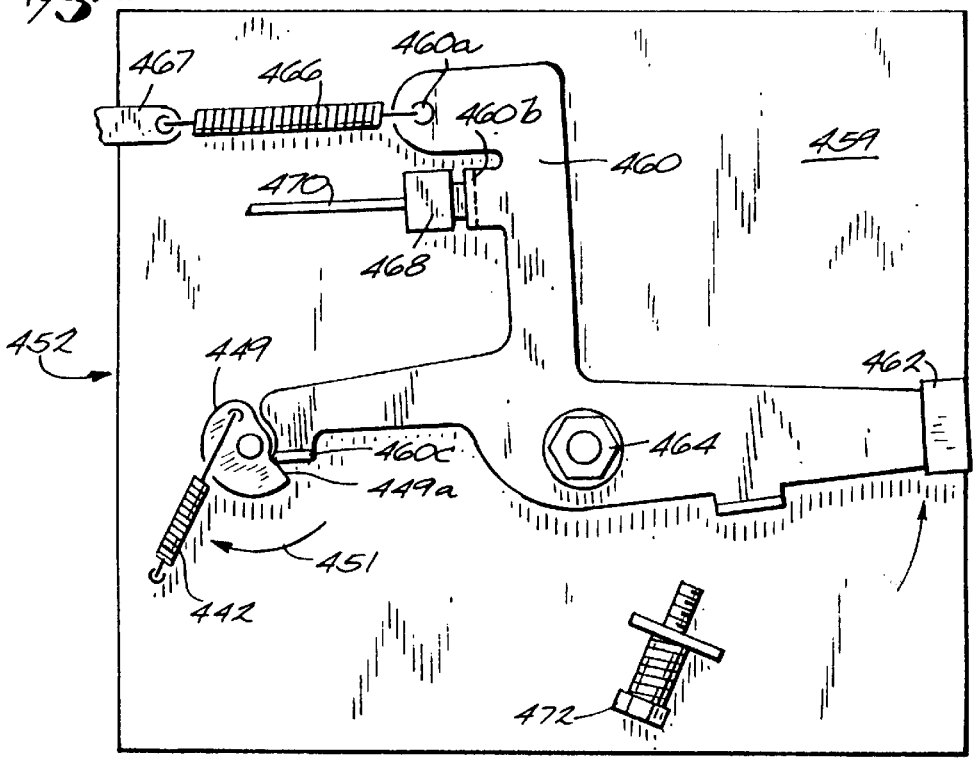

FUEL SHUTOFF SYSTEM

FIELD OF THE INVENTION

This application is a divisional application of U.S. patent application, Ser. No. 08/780,338, filed Jan. 8, 1997.

The present invention generally relates to the field of internal combustion engines and, more particularly, to internal combustion engines that utilize fuel shutoff systems upon engine shutdown.

BACKGROUND OF THE INVENTION

Internal combustion engines are used in a variety of applications, such as for lawn mowers, generators, pumps, snow blowers, and the like. Such engines often have carburetors wherein fuel received from a fuel source is mixed with air and supplied to a combustion chamber for ignition. The fuel mixture is drawn from the carburetor into the combustion chamber due to a low pressure created by the rotation of the engine. The products of combustion are then expelled from the combustion chamber into the exhaust manifold during the exhaust stroke of the engine.

An operator of an engine may shut the engine down by grounding the electrical ignition system, thereby causing the spark plug to cease firing. After shutdown, the engine does not immediately stop rotating. During the continued rotation or coasting of the engine after ignition shutdown, unburned fuel and air are drawn from the carburetor into the combustion chamber, and expelled into the exhaust system.

The continued draw of unburned fuel into the combustion chamber and exhaust manifold after engine shutdown causes problems. Fuel is wasted, and unburned fuel is released into the environment, thereby increasing exhaust emissions. Additionally, the muffler or muffler with catalytic converter often get very hot, and the unburned fuel may ignite when it contacts these components, thereby causing backfiring or afterburning. Backfiring and afterburning can shorten the useful life of the catalytic converter and of the muffler itself. Likewise, the presence of unburned fuel in the combustion chamber may cause dieseling.

To alleviate these problems, fuel shutoff mechanisms have been devised to control the flow of fuel after ignition shutdown. For instance, U.S. Pat. No. 5,301,644 to Olmr discloses a fuel shutoff mechanism which includes a solenoid valve. However, the '644 system, as well as other apparatus which use solenoids, typically require a battery to function. The addition of a battery to engines adds to the weight and cost of the engine. Additionally, solenoids, or other electric actuating devices, are expensive and are expensive to replace. In the small utility engine industry, for example, the additional cost, weight, and complexity are very undesirable.

Other fuel shutoff devices, such as the one disclosed in U.S. Pat. No. 5,092,295 to Kobayashi, use the throttle of the engine to act as a fuel blocker upon engine shutdown. This is done by adding structure which overrides the governor of the engine and closes the throttle valve upon shutdown. The problem with these devices, however, is that they are complex, and must be added onto and may disturb the delicate balance of the engine governor.

Yet other devices, such as U.S. Pat. No. 4,510,739 to Dluhosch, use a fuel shutoff valve which stops the flow of fuel into the fuel bowl. The disadvantage of these devices is that a substantial amount of fuel remains in the fuel bowl after the engine ignition is shut down, and can still be drawn into the combustion chamber and exhaust system after shutdown.

SUMMARY OF THE INVENTION

The invention is a fuel shutoff system that solves the problems of the prior art. More particularly, the invention includes a fuel shutoff system that is usable on engines without a battery, and is reliable, simple and less expensive than electrically operated solenoids. Additionally, the fuel shutoff operates without interfering with the engine governor, and effectively blocks the fuel flow downstream of the fuel bowl on engine shutdown.

One aspect of the invention is a fuel shutoff system for an internal combustion engine, wherein the engine has a carburetor with a fuel bowl, an intake valve, and a fuel conduit between the fuel bowl and the intake valve. The invention includes a means for selectively blocking the fuel conduit downstream of the fuel bowl to substantially prevent passage of fuel to the intake valve, and a manually-operable control for actuating the blocking means. In each embodiment, the engine includes a throttle, and the blocking means is distinct from the throttle.

In one embodiment of the invention, the engine includes a carburetor having a fuel nozzle, and the fuel shutoff system includes a mechanically operated means for selectively blocking fuel from flowing into the fuel nozzle. In one form, the blocking means includes a blocking member selectively positioned adjacent to the fuel nozzle in a first position wherein the blocking member blocks the fuel from flowing into the fuel nozzle, and in a second position wherein the blocking member allows the fuel to flow into the fuel nozzle.

In another embodiment of the invention, the engine has a passageway through which a gas (the fuel/air mixture) may pass to an intake valve of the engine, and the engine has a throttle valve disposed in the passageway. The blocking means includes a blocking member disposed in the passageway, and a means for selectively positioning the blocking member in a first open position, and in a second closed position upon engine shutdown to substantially block the flow of gas or fuel/air mixture to the intake valve and to the combustion chamber.

Another aspect of the invention is a means for grounding the ignition system of the engine wherein the fuel shutoff means and the grounding means are both actuated by operation of the same mechanical means.

An important feature and advantage of the invention is that the invention reduces the amount of unburned fuel which is wasted and released into the environment since all fuel flow is shut off upon engine shutdown.

Another feature and advantage of the invention is that the fuel shutoff, particularly at the fuel nozzle, enables the engine to be transported with fuel and oil without the fuel passing through the engine into the crankcase, thereby avoiding oil dilution and hydraulic lock.

Another feature and advantage of the invention is that the fuel shutoff, particularly at the fuel nozzle, enables the engine to be transported with fuel without the fuel flowing into the carburetor during transport, thereby avoiding the potential for engine flooding.

Other features and advantages of the invention will become apparent to those skilled in the art upon review of the following detailed description, claims and drawings.

BRIEF DESCRIPTION OF THE DRAWINGS

FIG. 5 is a partial side view of a blocking member used in a second embodiment of the invention, shown in partial section, depicting a rotatable lever arm interconnected with the blocking member.

FIG. 6 is a schematic view of a control lever used in a third embodiment of the invention, depicting a bowden wire directly connected to the control lever.

FIG. 7 is a perspective view of a push pull motion type lever-bowden cable assembly of a fourth embodiment of the invention.

FIG. 9 is a schematic view of a control lever of the fifth embodiment, in the run position.

FIG. 10 is a schematic view of the control lever of the fifth embodiment of the invention, in the shutoff position.

DETAILED DESCRIPTION OF THE PREFERRED EMBODIMENTS

Figure 1:
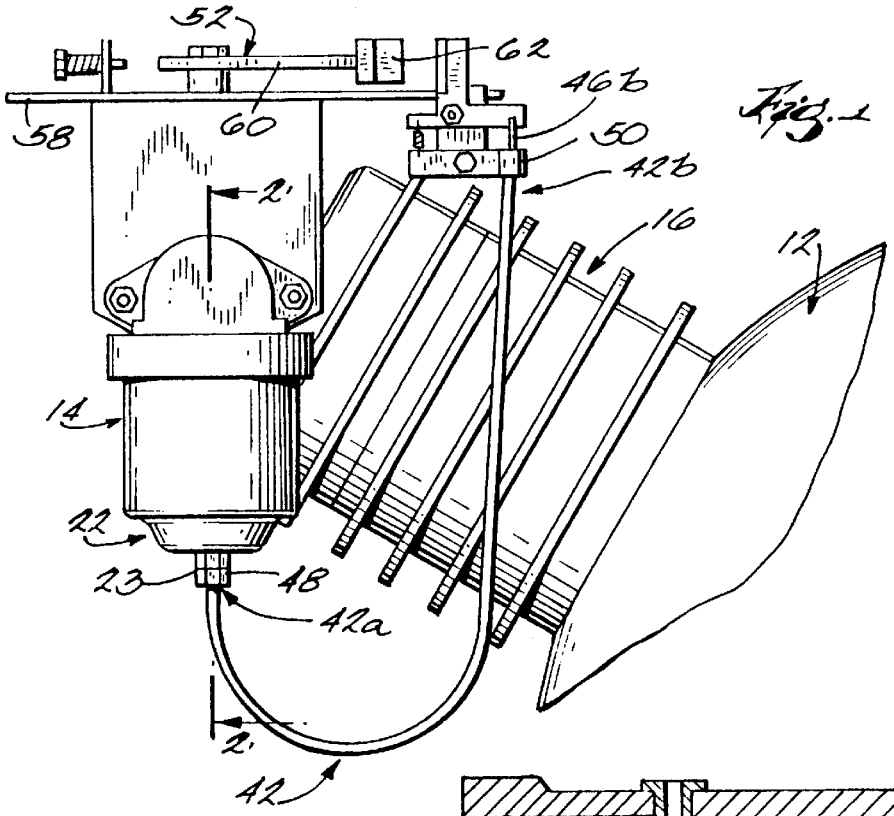
FIG. 1 is a partial side view of an internal combustion engine depicting a first embodiment of the present invention.
Figure 2:
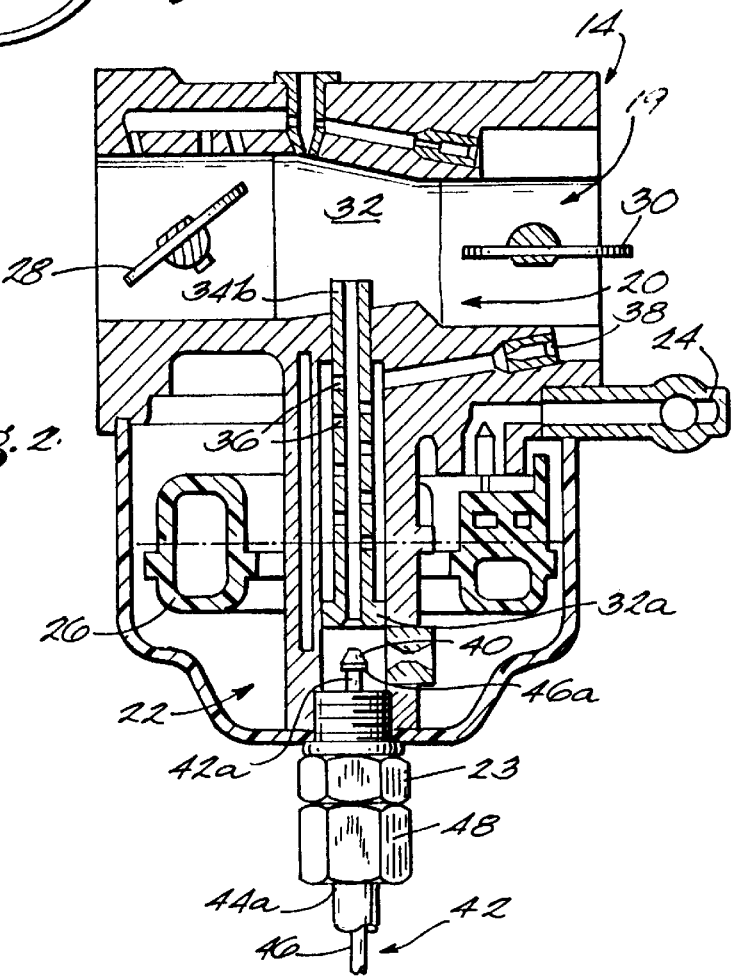
FIG. 2 is a cross sectional side view of a carburetor used in the first embodiment.

FIGS. 1 through 15 illustrate a number of embodiments of the present invention. Each of the illustrated embodiments of the invention is used with an internal combustion engine having a carburetor and a combustion chamber. In FIGS. 1 and 2, engine 12 has a gas passageway 19 through which gas (the fuel/air mixture) may pass to an intake valve (not shown) of the engine 12. Carburetor 14 has a carburetor body 18 having a throat 20 extending therethrough, and a fuel bowl 22 secured to carburetor body 18 by a carburetor bowl mounting screw 23. Throat 20 has a throttle valve 28 and a choke valve 30 disposed therein. Throat 20 also has a reduced diameter portion or venturi 32 disposed therein, and one end which is interconnected with an intake manifold (not shown) in fluid flow communication with an intake valve (not shown). Gas passageway 19 includes throat 20 of carburetor 14 and the intake manifold (not shown). The intake valve (not shown) regulates the flow of air and fuel into a combustion chamber 16.

The illustrated embodiments also include a fuel feed line 24 that acts as a passageway for fuel to flow from a fuel tank (not shown) to carburetor 14, and into fuel bowl 22. Carburetor 14 has a float 26 which floats on fuel in fuel bowl 22 and actuates a valve which blocks fuel from flowing into the fuel bowl 22 when fuel bowl 22 is full. A fuel nozzle 34 extends from fuel bowl 22 to venturi 32, having one end 34*a* in fuel bowl 22, and another end 34*b* in venturi 32. Fuel nozzle 34 has multiple apertures for air 36 disposed in the side thereof. An air bleed 38 is disposed in the carburetor body 18 and extends from near one side of the fuel nozzle 34 to an outer wall of the carburetor body 18. Fuel nozzle 34, throat 20, and the intake manifold (not shown) comprise a fuel conduit between fuel bowl 22 and the intake valve (not shown).

When engine 12 is running, fuel flows from the fuel tank (not shown), through the fuel feed line 24, into the fuel bowl 22, up through the fuel nozzle 34, into the gas passageway 19, into the intake manifold (not shown), through the intake valve (not shown), and into combustion chamber 16.

Each of the illustrated embodiments in FIGS. 1 through 15, as will be described below, also includes a blocking means including a blocking member for selectively blocking the fuel conduit downstream of the fuel bowl to substantially prevent the passage of fuel to the intake valve.

Figure 3:
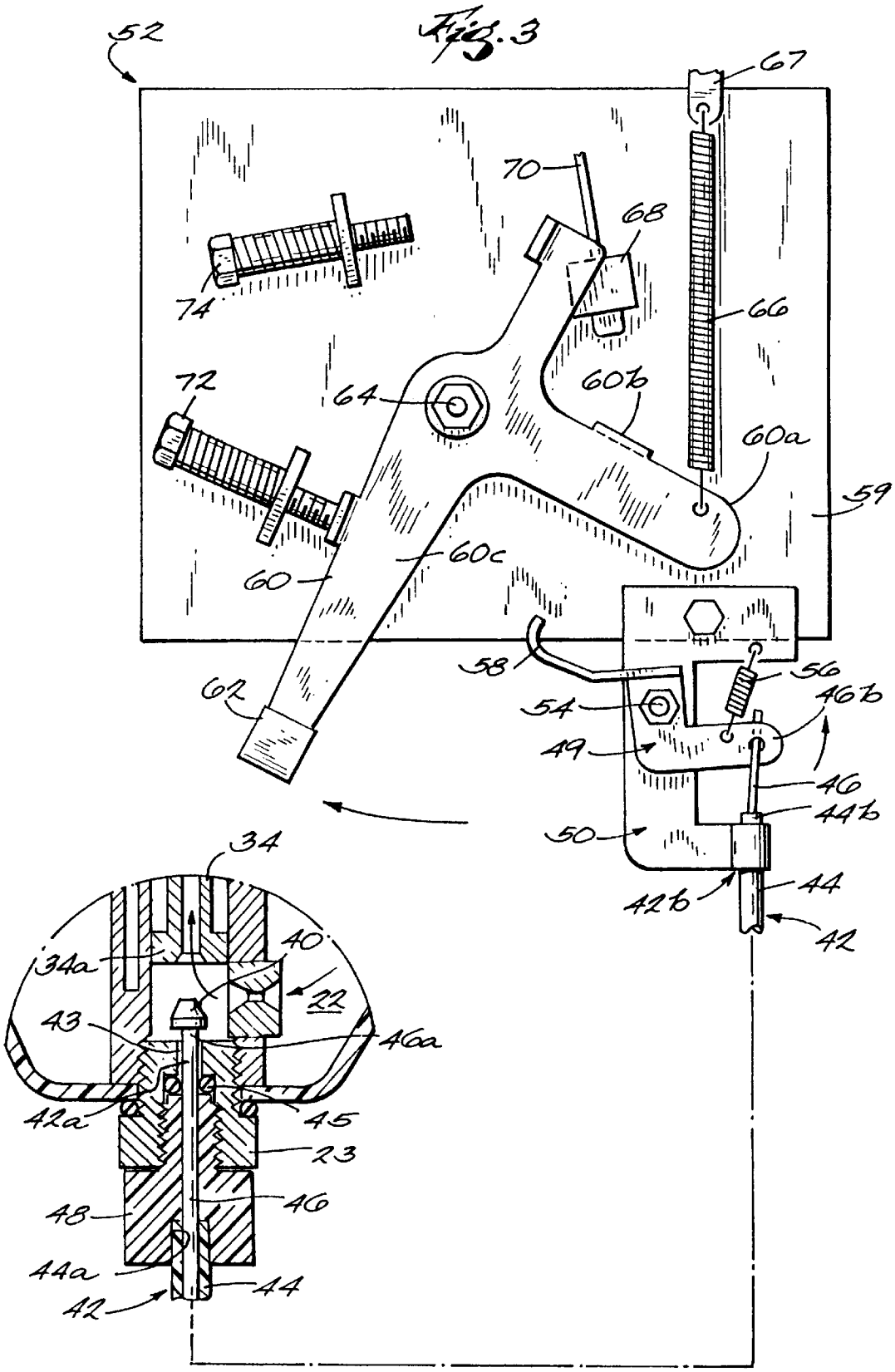
FIG. 3 is a schematic view of the first embodiment in the run position.
Figure 4:
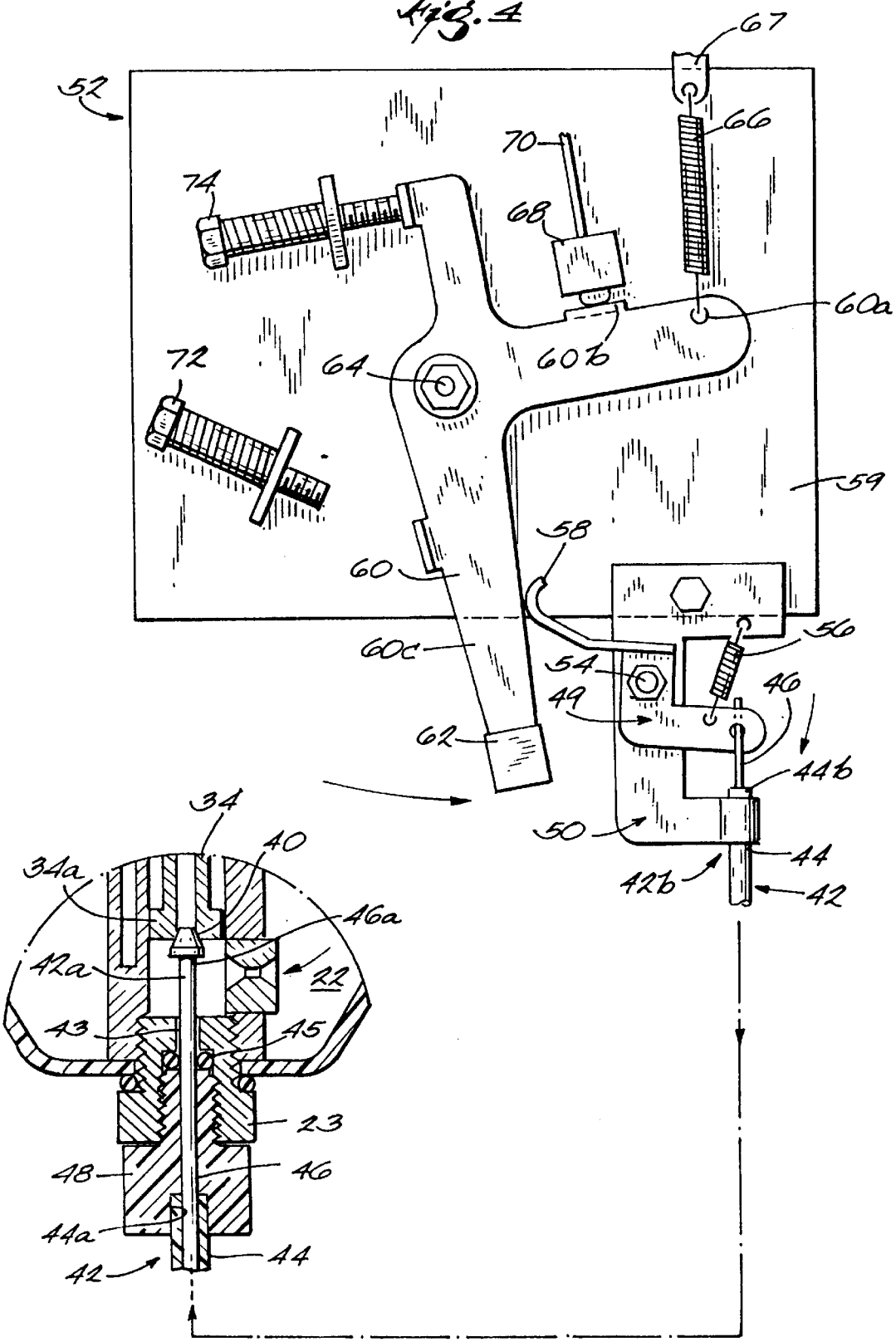
FIG. 4 is a schematic view of the first embodiment in the stop position.

FIGS. 1 through 4 illustrate a first embodiment of the present invention. Referring to FIGS. 2 through 4, a blocking member or plunger 40 is located in fuel bowl 22 adjacent to an input end 34*a* of fuel nozzle 34. Plunger 40 is selectively movable between a stop position in which plunger 40 blocks the flow of fuel into fuel nozzle 34, as shown in FIG. 4, and a run position in which plunger 40 does not block the flow of fuel into fuel nozzle 34, as shown in FIG. 3. Plunger 40 is preferably in the shape of a truncated cone for better sealing with the input end 34*a* of fuel nozzle 34. Additionally, plunger 40 is preferably made of material such as a metal, plastic or rubber that is insoluble in and impervious to fuel.

Although the blocking member has been depicted and described as a plunger blocking the input end of the fuel nozzle, it is apparent that the blocking member may have a different shape (eg. a plate), and that it could be placed at the output end of the fuel nozzle or in a slot in the nozzle between the input and output ends.

Plunger 40 in the first embodiment is selectively movable between the stop or blocking position, and the run or non-blocking position through the use of a bowden cable 42 interconnected with a lever assembly 52. Bowden cable 42 has one end 42*a* attached to plunger 40 and extends from plunger 40 through an aperture 43 drilled through carburetor bowl mounting screw 23. Bowden cable 42 then extends to and has a second end 42*b* interconnected with an actuating lever assembly 52.

Plunger 40 is directly attached to one end 42*a* of bowden cable 42, and in one embodiment, plunger 40 and bowden cable 42 are at least partially made of metal, and bowden cable 42 is attached by soldering or other means to plunger 40. A tight seal is created between bowden cable 42 and carburetor bowl mounting screw 23, such that fuel cannot leak from fuel bowl 22 through aperture 43 in carburetor bowl mounting screw 23. An O-ring 45 or other similar means is used to create such a seal. In the first embodiment, the O-ring 45 may be supplied by National O-Ring, 11634 Patton Road, Downey, Calif. 90241.

Bowden cable 42 has an outer sheath 44 and an inner wire 46. Inner wire 46 is slightly longer than outer sheath 44, and is attached to plunger 40 on one end 46*a* and to an actuator lever 49 on the other end 46*b*. The outer sheath 44 surrounds the inner wire 46 and has an end 44*a* nearest the plunger 40 that is locked into position by a jam nut 48 which is attached to carburetor bowl mounting screw 23. The end 44*b* of the outer sheath 44 that is interconnected with the actuating lever assembly 52 is locked into position by a bowden cable clamp 50. One suitable bowden cable 42 is supplied by Capro Inc., 300 South Cochran, Willis, Tex. 77378.

As shown in FIGS. 3 and 4, the major components of actuating lever assembly 52 include actuator lever 49, a control lever 60, and a mounting plate 59.

In FIGS. 3 and 4, actuator lever 49 includes a first pivot 54, a return spring 56, and an engagement arm 58. First pivot 54 mounts actuator lever 49 to bowden cable clamp 50, which is in turn mounted to mounting plate 59. First pivot 54 allows actuator lever 49 to pivot between a run position as illustrated in FIG. 3, and a stop position as illustrated in FIG. 4. Because actuator lever 49 is interconnected with plunger 40 via bowden cable 42 when in the run position, actuator lever 49 pulls bowden cable 42 so that plunger 40 is in a non-blocking position. When in the stop position, actuator lever 49 pushes bowden cable 42 so that plunger 40 is in the blocking position.

Actuator lever 49 is moved between the run and the stop positions through the selective engagement of engagement arm 58 with control lever 60. Engagement arm 58 acts as a lever to pivot actuator lever 49 between the run and stop positions. Return spring 56 is interconnected between actuator lever 49 and bowden cable clamp 50, and returns actuator lever 49 to the run position when engagement arm 58 is not engaged with the control lever 60. In an alternate embodiment, actuator 49 may be spring biased to the closed or off position so that the engine may be transported without fuel spillage.

As shown in FIGS. 3 and 4, control lever 60 is preferably a rotary motion lever that has a handle or tab 62, and a second pivot 64. Of course, other types of levers may be used.

Second pivot 64 mounts control lever 60 to mounting plate 59 and allows for rotary motion of control lever 60 in relation to mounting plate 59. Control lever 60 has one portion 60*a* that is interconnected with a governor spring 66, another portion 60*b* which is selectively engageable with an ignition ground switch 68, and another portion 60*c* that is selectively engageable with engagement arm 58.

Governor spring 66 is interconnected between a governor arm 67 and control lever 60 and acts to adjust the speed of engine 12 (FIG. 1) as control lever 60 is rotated. As control lever 60 is rotated in a clockwise direction, as illustrated in FIG. 3, governor spring 66 is tightened, throttle valve 28 (FIG. 2) is moved to a more open position, and the engine runs faster. As control lever 60 is rotated in a counter-clockwise direction, as illustrated in FIG. 4, governor spring 66 is loosened, throttle valve 28 (FIG. 2) is moved to a more closed position, and the engine runs slower. Therefore, control lever 60 is a manually-operable control that controls both the throttle valve 28 and the blocking member or plunger 40.

In fixed speed applications, such as generators and the like, the throttle position is often not manually-controllable. In these applications, control lever 60 would only control the blocking member, and governor spring 66 would not be interconnected with control lever 60.

Ignition ground switch 68 is interconnected with an ignition wire 70, and selectively grounds the ignition system (not shown) of engine 12 (FIG. 1) to stop the engine. The fuel shutoff system of the present invention should stop the engine without the ignition ground switch. When control lever 60 engages ignition ground switch 68, ignition ground switch 68 grounds the ignition system, and the engine stops. In the preferred embodiment, the ignition ground switch 68 may be supplied by Fastex Division, 195 Algonquin Road, Des Plaines, Ill. 60016.

Control lever 60 only engages ignition ground switch 68 and engagement arm 58 when it is in the fully counter-clockwise position illustrated in FIG. 4. Therefore, the ignition system is grounded and plunger 40 is moved to the blocking position only when control lever 60 is in the fully counter-clockwise position. Plunger 40 is fully closed and ignition ground switch 68 are actuated at substantially the same time by control lever 60.

Referring again to FIGS. 3 and 4, two adjustable stops 72 and 74 are on mounting plate 59, and limit the rotary motion of control lever 60. First stop 72 stops the control lever 60 in an engine run position, as illustrated in FIG. 3. Second stop 74 stops control lever 60 in an engine stop position, as illustrated in FIG. 4.

FIG. 5 illustrates a blocking member or plunger 140 and a mechanical actuating means used in a second embodiment of the invention. As in the first embodiment, plunger 140 is located in a fuel bowl 122 adjacent to an intake end 134*a* of a fuel nozzle 134. Plunger 140 is selectively movable between a first, stop position in which plunger 140 blocks the flow of fuel into fuel nozzle 134 (shown in phantom in FIG. 5), and a second, run position in which plunger 140 does not block the flow of fuel into fuel nozzle 134 (shown by the solid lines in FIG. 5).

Although blocking member 140 has been depicted and described as a plunger 140 blocking input end 134*a* of fuel nozzle 134, it is apparent that blocking member 140 may have a different shape (eg. a plate), and that it could be placed at the output end 34*b* (FIG. 2) of fuel nozzle 134 or in a slot in the fuel nozzle between input end 134*a* and output end 134*b* (FIG. 2).

Plunger 140 in FIG. 5 is selectively movable between the stop or blocking position, and the run or non-blocking position through the use of a connecting member 142 interconnected with a rotating actuating lever assembly 152. Connecting member 142 has one end 142*a* attached to plunger 140, and extends from plunger 140 through an aperture 143 drilled through the center of the carburetor bowl mounting screw 123. Connecting member 142 then extends to and has a second end 142*b* interconnected with a rotating actuating lever assembly 152.

A tight seal is created between connecting member 142 and carburetor bowl mounting screw 123, such that fuel cannot leak from fuel bowl 122 through aperture 143. As in the first embodiment, an O-ring 145 or other similar means is used to create such a seal.

Carburetor bowl mounting screw 123 has an internally threaded bore 125 therein, and the actuating lever assembly 152 includes a threaded member 144 which is threaded into threaded bore 125. One end 144*a* of threaded member 144 is connected to connecting member 142, and the other end 144*b* of threaded member 144 is connected to a lever arm 149. When lever arm 149 is rotated such that the pitch of the thread in threaded bore 125 advances threaded member 144 further into threaded bore 125, plunger 140 is advanced towards the intake end 134*a* of fuel nozzle 134 via connecting member 142. When plunger 140 contacts or substantially contacts the intake end 134*a* of fuel nozzle 134, plunger 140 blocks or substantially blocks the flow of fuel into fuel nozzle 134, and is therefore in the stop or blocking position.

As lever 149 arm is rotated such that the pitch of the thread in threaded bore 125 moves threaded member 144 further out of threaded bore 125, plunger 140 is moved away from intake end 134*a* of fuel nozzle 134 via connecting member 142. When plunger 140 is not in contact or substantial contact with intake end 134*a* of fuel nozzle 134, plunger 140 does not block or substantially block fuel from flowing into fuel nozzle 34, and is therefore in the run or non-blocking position.

FIG. 6 illustrates an actuating lever assembly 252 used in a third embodiment of the invention. In the actuating lever assembly 252 of the third embodiment, a bowden cable 242 is directly attached to a rotary motion control lever 260 via an adjustment bolt 280. Adjustment bolt 280 is attached to control lever 260 at an elongated opening or adjustment slot 282 in the control lever 260. For calibration of the embodiment, the attachment point of bowden cable 242 to control lever 260 can be adjusted by repositioning adjustment bolt 280 in adjustment slot 282. By repositioning the attachment point of bowden cable 242 to control lever 260, the movement of bowden cable 242 in relation to the movement of control lever 260 is adjusted. Additionally, the end 244*a* of an outer sheath 244 of bowden cable 242 is held in position by a second jam nut 250 which is connected to the mounting plate 259, rather than by a bowden cable clamp 50 (FIGS. 3 and 4) as in the first embodiment.

The actuating lever assembly 252 in the third embodiment also includes an ignition ground switch 268 interconnected with an ignition wire 270, an adjustable stop 272, and a second pivot 264, which are similar to the corresponding components discussed above in the first embodiment.

FIG. 7 illustrates yet another actuating lever assembly 352 used in a fourth embodiment of the invention. In the fourth embodiment, actuating lever assembly 352 includes a remote control lever 360 which is a push/pull motion type lever. Control lever 360 includes a push/pull knob 362, a connecting member 342, and a stop 372. Connecting member 342 may be connected to a bowden cable 342, which in turn is interconnected with the blocking member 40 (FIGS. 2 and 4), or connecting member 342 may be connected directly to blocking member 40 (FIGS. 2 and 4). When the push/pull knob 360 is pulled out in relation to the stop 372, blocking member 40 (FIGS. 2 and 4) is positioned such that it does not block the fuel flow in the fuel conduit, and the embodiment is in the run or non-blocking position. When the push/pull knob 362 is pushed-in in relation to the stop 372, blocking member 40 (FIGS. 2 and 4) is positioned such that it blocks the fuel flow in the fuel conduit, and the embodiment is in the stop or fuel blocking position.

In the fourth embodiment, an ignition ground switch 68 (FIGS. 1 and 3) is also interconnected with the actuating lever assembly 352. The ignition ground switch 68 (FIGS. 1 and 3) may be interconnected with the actuating lever assembly 352 via bowden cable 342, or may be directly attached to actuating lever assembly 352. When the push/pull knob 360 is pushed-in to the stop position, the ignition ground switch 68 (FIGS. 1 and 3) is actuated, and grounds the ignition system of the engine.

Figure 8:
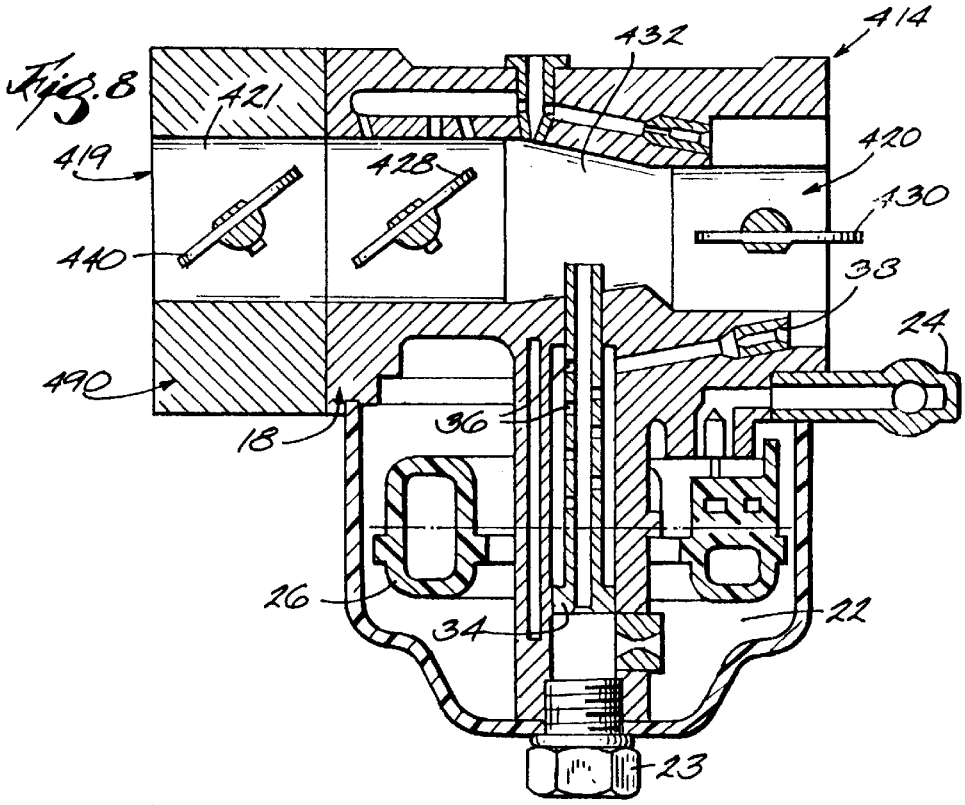
FIG. 8 is a cross sectional side view of a carburetor according to a fifth embodiment of the invention, depicting a blocking member in the gas passageway.

FIGS. 8 through 10A depict a fifth embodiment of the present invention. As best shown in FIG. 8, a blocking member or fuel/air mixture blocking valve 440 is disposed in a gas passageway 419 of the engine 12 (FIG. 1). A throttle valve 428 and a choke valve 430 are also disposed in the gas passageway 419, and are distinct from blocking member 440. In FIG. 8, a spacer block 490 is located between the carburetor 414 and the intake manifold (not shown). Spacer block 490 has a hollow bore 421 therethrough, and is positioned such that hollow bore 421 is included in gas passageway 419. Carburetor throat 420, having a venturi 432, is also part of the gas passageway 419. Fuel blocking valve 440 is disposed within hollow bore 421 of spacer block 490.

Figure 9A:
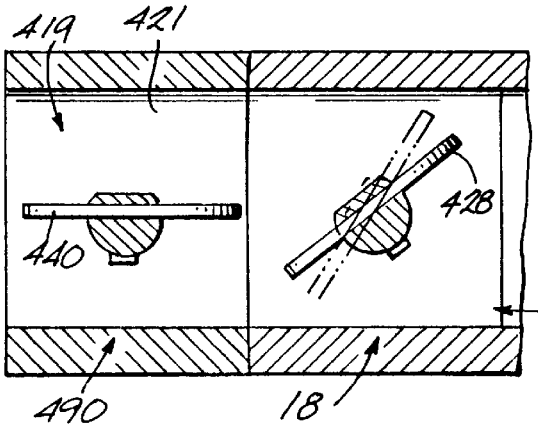
FIG. 9A is an exploded side view of the blocking member according to the fifth embodiment, depicted in the run position.
Figure 10A:
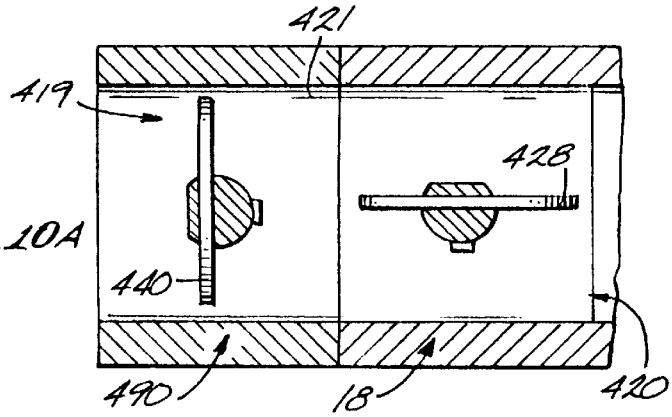
FIG. 10A is an exploded side view of the blocking member according to the fifth embodiment, depicted in the shutoff position.

Fuel blocking valve 440 is selectively movable between a first, stop position in which blocking valve 440 blocks the flow of the air/fuel mixture in gas passageway 419, as illustrated in FIG. 10A, and a second, run position in which blocking valve 440 does not block the flow of the air/fuel mixture in gas passageway 419 as illustrated in FIG. 9A. Fuel blocking valve 440 is preferably in the form of a butterfly valve, and is sized such that when in a blocking position, fuel blocking valve 440 blocks, or substantially blocks, the flow of the air/fuel mixture through gas passageway 419. (FIG. 10A).

Fuel blocking valve 440 in the fifth embodiment is selectively movable between the blocking position and the non-blocking position through the use of an actuating lever assembly 452 interconnected with fuel blocking valve 440. Referring to FIGS. 9 and 10, the major components of actuating lever assembly 452 include a control lever 460, an actuator cam 449, a cam spring 442 and a mounting plate 459.

As depicted in FIGS. 9 and 10, control lever 460 is a rotary motion lever that has a handle or tab 462, and a second pivot 464. Of course, other types of levers may be used. Control lever 460 has one portion 460*a* that is interconnected with a governor spring 466, another portion 460*b* which is selectively engageable with an ignition ground switch 468, and another portion 460*c* that is selectively engageable with actuator cam 449. As control lever 460 is rotated so as to engage actuator cam 449, actuator cam 449 is rotated in a clockwise direction, as shown by arrow 451.

In the fifth embodiment, there is a direct mechanical link between actuator cam 449 (FIGS. 9 and 10) and fuel blocking valve 440 (FIGS. 9A and 10A). The link may be a shaft, a rack and pinion apparatus, or gears, as is well known in the trade. Other embodiments of the invention may link actuator cam 449 and fuel blocking valve 440 through the use of a bowden cable, or other similar means.

As actuator cam 449 is rotated in a clockwise direction through engagement with control lever 460, fuel blocking valve 440 is moved from a non-blocking to a blocking position via the direct mechanical link between fuel blocking valve 440 and actuator cam 449. The use of actuator cam 449 allows for efficient switching of fuel blocking valve 440 between the blocking and non-blocking positions. Due to the profile of cam surface 449*a* of the actuator cam 449, once speed control lever 460 engages actuator cam 449, a small amount of angular movement of control lever 460 results in a large amount of angular movement of fuel blocking valve 440, thereby reducing the amount of control lever movement needed to actuate fuel blocking valve 440 into a blocking position. By comparing FIGS. 9 through 10A, it is apparent that a rotation of cam 449 of less than 45 degrees from the open position (FIG. 9) to the closed position (FIG. 10) results in a 90 degree rotation of fuel blocking valve 440 from the open position (FIG. 9A) to the closed position (FIG. 10A). Fuel blocking valve 440 is spring loaded so that fuel blocking valve 440 remains in the fully open or non-blocking position when control lever 460 is not engaging actuator cam 449.

Ignition ground switch 468 in the fifth embodiment is similar to ignition ground switch 68 (FIGS. 3 and 4) discussed above in the first embodiment. Additionally, the structure relating to the governor spring 466 and its attachment between governor spring 467 and control lever 460 in the fifth embodiment is substantially the same as in the first embodiment discussed above. As in the first embodiment, the governor spring is not attached to control lever 460 in most fixed speed applications.

The operation of the fifth illustrated embodiment of the invention is best shown by comparing FIGS. 9 and 9A with FIGS. 10 and 10A. FIGS. 9 and 9A, in combination, illustrate the fifth embodiment of the invention in the run, non-blocking and non-grounding position. Control lever 460 is in a position such that it does not engage actuator cam 449. In this position, actuator cam 449 is held in a run position by cam spring 442. Fuel blocking valve 440 remains in a non-blocking position, thereby allowing the air/fuel mixture to flow through gas passageway 419 and to the intake valve. In this position, control lever 460 does not engage ignition ground switch 468, so the ignition system of the engine is not grounded. Additionally, governor spring 466 is pulled, thereby moving throttle valve 28 into a more open position, making the engine 12 run faster.

The phantom lines in FIGS. 9 and 9A illustrate the fifth embodiment in a slow run position, with throttle valve 28 partially closed, fuel blocking valve 440 in a non-blocking position, and ignition ground switch 468 and actuator cam 449 not actuated by control lever 460. The solid lines in FIGS. 9 and 9A illustrate the fifth embodiment in the fast run position, with control lever 460 engaging stop 472, throttle valve 428 more open, fuel blocking valve 440 in a non-blocking position, and ignition ground switch 468 and actuator cam 449 not actuated by control lever 460.

FIGS. 10 and 10A illustrates the fifth embodiment of the invention in the stop, blocking and grounding position. Control lever 460 is rotated as far counter-clockwise as possible so that control lever 460 engages actuator cam 449. In this position, control lever 460 engages actuator cam 449 such that fuel blocking valve 440 is rotated to the blocking position, thereby substantially blocking the air/fuel mixture from flowing through gas passageway 419 into the intake valve. Control lever 460 engages ignition ground switch 468, so that the ignition system of the engine is grounded. Additionally, governor spring 466 is loosened thereby moving throttle valve 428 into a fully open position.

Control lever 460 only engages ignition ground switch 468 and actuator cam 449 when it is in or substantially close to the fully counter-clockwise position illustrated in FIG. 10. Therefore, ignition ground switch 468 is actuated and fuel blocking valve 440 is in the blocking position only when control lever 460 is in the fully counter-clockwise position. Actuator cam 449, and therefore fuel blocking valve 440 as well as ignition ground switch 468, are actuated at substantially the same time by control lever 460.

Figure 11:
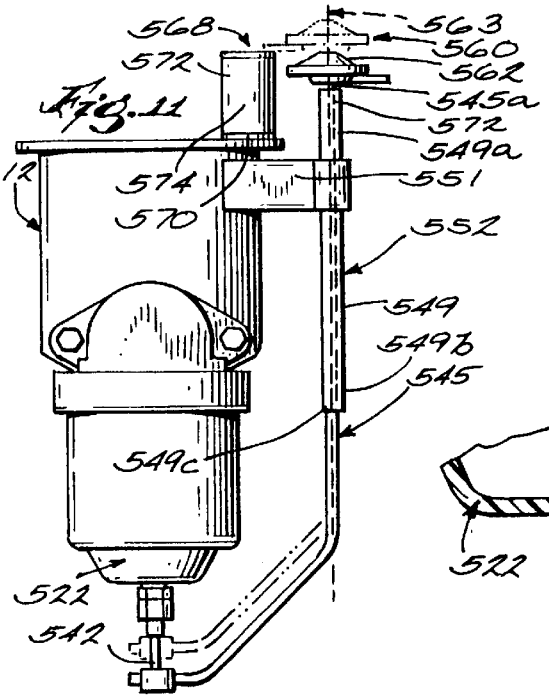
FIG. 11 is a partial side view of an internal combustion engine depicting a sixth embodiment of the present invention.
Figure 12:
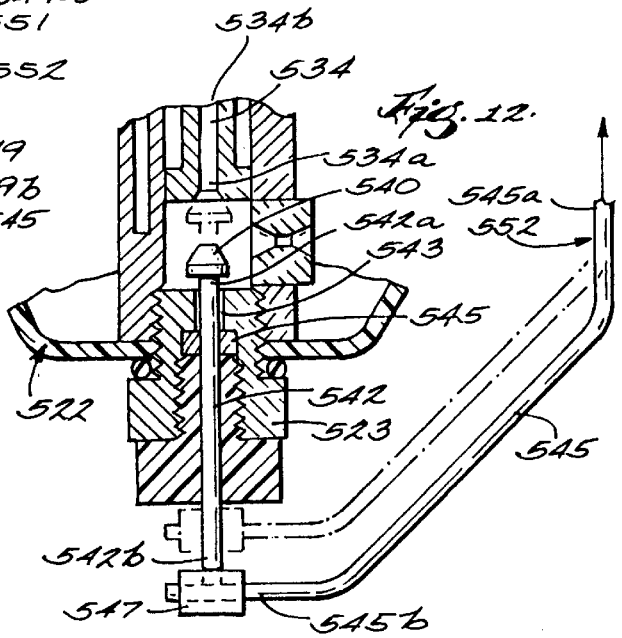
FIG. 12 is a partial cross-sectional view of a carburetor used in the sixth embodiment of the invention.

FIGS. 11 through 15 illustrate a mechanical actuating means used in a sixth embodiment of the invention using a link arm lever assembly 552. As shown in FIG. 12, plunger 540 is located in a fuel bowl 522 adjacent to an intake end 534*a* of a fuel nozzle 534. Plunger 540 is selectively movable between a first, stop position in which plunger 540 blocks the flow of fuel into fuel nozzle 534 (shown in phantom in FIG. 12), and a second, run position in which plunger 540 does not block the flow of fuel into fuel nozzle 534 (shown by the solid lines in FIG. 12).

Although blocking member 540 has been depicted and described as a plunger 540 blocking input end 534*a* of fuel nozzle 534, it is apparent that blocking member 540 may have a different shape (eg. a plate), and that it could be placed at the output end 534*b* of fuel nozzle 534 or in a slot in the fuel nozzle between input end 534*a* and output end 534*b*.

Plunger 540, as shown in FIG. 12, is selectively movable between the stop or blocking position, and the run or non-blocking position through the use of a connecting member 542 interconnected with a link arm lever assembly 552. Connecting member 542 has one end 542*a* attached to plunger 540, and extends from plunger 540 through an aperture 543 drilled through the center of the carburetor bowl mounting screw 523. Connecting member 542 then extends to and has a second end 542*b* interconnected with the link arm lever assembly 552.

A tight seal is created between connecting member 542 and carburetor bowl mounting screw 523, such that fuel cannot leak from fuel bowl 522 through aperture 543. As in the first embodiment, an O-ring 595 or other similar means is used to create such a seal.

The link arm lever assembly 552 includes a generally L-shaped link arm 545 having a first end 545*a* and a second end 545*b*. The second end of link arm 545*b* is interconnected with the second end of connecting member 542*b*. As shown in FIG. 12, the second end of link arm 545*b* and the second end connecting member 542*b* are interconnected by an interconnecting member 547. In the alternative, the link arm 545 and the connecting member 542 can be interconnected by other interconnecting means known in the art, such as welding, or may be integrated together into a single part.

As shown in FIG. 11, a guide member 549 is attached to engine 12 by guide member retainer bracket 551. Guide member 549 is an elongated tube having an elongated bore 549*c* extending therethrough about axis 563. Guide member 549 has a first end 549*a* and a second end 549*b*. Link arm 545 extends through and is slidably engaged with bore 549*c* from second end 549*b* to first end 549*a* about axis 563.

Figure 14:
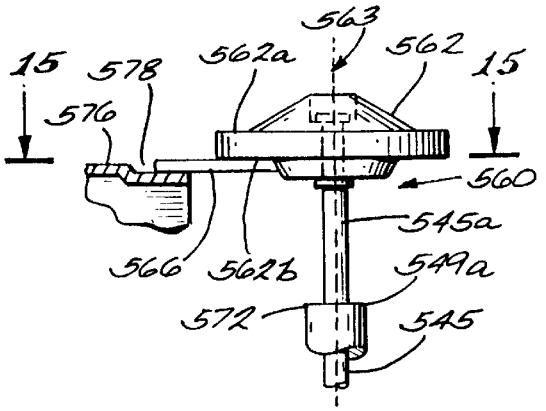
FIG. 14 is a side view of the push/pull motion type lever-link arm assembly used in the sixth embodiment of the invention.

The first end of link arm 545*a* extends from the first end of guide member 549*a* and is interconnected with a push/pull motion type lever 560. The lever 560 includes a push/pull motion knob 562, and a stop 572. Referring to FIG. 14, knob 562 is rotatably mounted on first end 545*a* such that knob 562 can generally rotate about axis 563. Knob 562 is a generally disc shaped member having a top edge 562*a* and a bottom edge 562*b*. A locking member 566 is mounted to the bottom edge 562*b*, and extends horizontally therefrom.

As shown in FIG. 14, the first end of guide member 549*a* acts as the stop 572 for lever 560. In other embodiments, a separate stop member can be employed.

Figure 15:
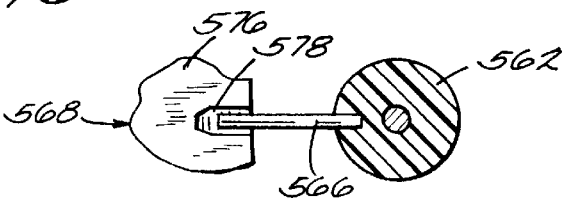
FIG. 15 is a top cross-sectional view of the push/pull knob, taken along line 15—15 in FIG. 14.

Referring to FIG. 11, a locking bracket 568 is mounted to the engine 12 substantially adjacent to knob 562. Bracket 568 is a generally C-shaped member having a first arm 570, a second arm 572 and a web 574 interconnecting arms 570 and 572 respectively. First arm 570 is attached to the engine 12. Second arm 572 has a top surface 576 having a recess 578 therein as shown in FIGS. 14 and 15.

As shown in phantom in FIGS. 11 and 12, as the push/pull knob 562 is pulled out in relation to the stop 572, plunger 540 is advanced towards the intake end 534*a* of fuel nozzle 534 via link arm 545 and connecting member 542. When plunger 540 contacts or substantially contacts the intake end 534*a* of fuel nozzle 534, plunger 540 blocks or substantially blocks the flow of fuel into fuel nozzle 534, and is therefore in the stop or blocking position. As shown in FIGS. 14 and 15, and as shown in phantom if FIG. 11, the knob 562 can then rotated about axis 563 such that locking member 566 is engaged with locking bracket 568 and fits within recess 578. In this position, the plunger 540 is held substantially in the stop position.

To unlock the locking member, the knob is rotated such that locking member 566 does not engage the locking bracket 568. As shown in FIGS. 11 and 12, as the push/pull knob 562 is pushed-in in relation to the stop 572, plunger 540 is moved away from intake end 534*a* of fuel nozzle 534 via link arm 545 and connecting member 542. When plunger 540 is not in contact or in substantial contact with intake end 534*a* of fuel nozzle 534, plunger 540 does not block or substantially block fuel from flowing into fuel nozzle 534, and is therefore in the run or non-blocking position.

Figure 13:
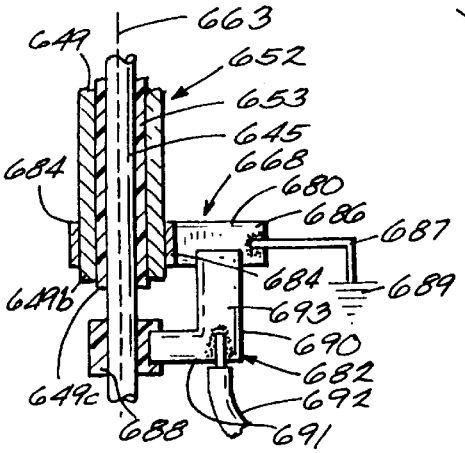
FIG. 13 is a partial side view of an ignition ground switch that may be used in the sixth embodiment of the invention.

FIG. 13 depicts an ignition ground switch that may optionally be used with the sixth embodiment discussed above. In FIG. 13, ignition ground switch 668 is interconnected with the link arm lever assembly 652. In FIG. 13, the ground switch assembly includes an elongated tube shaped guide member 649 having an elongated bore 649*c* extending therethrough about axis 663. The guide member includes a second end 649*b*. The ground switch assembly may also include an interior surface 651 of bore 649*a* being coated with a non-conductive layer 653. Non-conductive layer 653 can be made of rubber or plastic, or any other non-conductive material known in the art. Link arm 645 extends through and slidably engages the non-conductive layer within bore 649*c* about axis 663.

The ignition ground switch 668 includes an upper portion 680 and a lower portion 682. Upper portion 680 includes an upper ground clip 684 attached to the second end of guide member 649*b*. An upper engagement member 686 made of conductive material is attached to upper ground clip 684 and extends substantially horizontally from guide member 649. The conductive material can include conductive metal known in the art, such as iron, steel, aluminum, and copper, or may include other conductive material. A ground wire 687 is connected to the engagement member 686 and extends to a grounding point 689.

Lower portion 682 includes a lower ground clip 688 made of substantially non-conductive material attached to link arm 645. Lower ground clip 688 is attached to link arm 645 at a point below guide member 649 such that when link arm 645 is in the stop or blocking position, the lower ground clip 688 nearly engages the second end 649*b* of guide member 649, and when link arm 645 is in the run or non-blocking position, the lower ground clip 688 is spaced substantially from the second end 649*b* of guide member 649. A substantially L-shaped lower engagement member 690 made of conductive material is attached to lower ground clip 688. Lower engagement member 690 has a first, horizontally extending portion 691, and a second vertically extending portion 693. The conductive material can include conductive metal known in the art, such as iron, steel, aluminum, and copper, or may include other conductive material. An ignition wire 692 is connected to the engagement member 690.

As shown in FIG. 13, when the link arm lever assembly 652 is in the stop or blocking position, the vertically extending portion 693 of lower engagement member 690 engages the upper engagement member 686, and grounds the ignition system of the engine. When the link arm lever assembly 652 is in the run or non-blocking position, the vertically extending portion 693 of lower engagement member 690 does not engage the upper engagement member 686, and the ignition system of the engine is not grounded.

While several embodiments of the present invention have been shown and described, other embodiments will be apparent to those skilled in the art and are within the intended scope of the present invention. The present invention includes any manually-operated means for blocking the flow of fuel or an air/fuel mixture, downstream of the fuel bowl and upstream of the engine intake valve upon engine shutdown. Therefore, the scope of the present invention is to be limited only by the following claims.

I claim:

1. A fuel shutoff system for an internal combustion engine, said engine having a carburetor with a fuel bowl, an intake valve, a throttle valve, and a fuel conduit between said fuel bowl and said intake valve, said shutoff system comprising:

means, distinct from said throttle valve, for selectively blocking said fuel conduit downstream of said fuel bowl to substantially prevent passage of fuel to said intake valve;

a manually-operable control for actuating said blocking means;

means for grounding ignition pulses from an engine ignition, said grounding means including an ignition ground switch connected in circuit with said ignition; and means for selectively actuating said ground switch to ground said ignition pulses upon operation of said control.

2. The fuel shutoff system of claim 1, wherein said fuel shutoff system further comprises:

a lever; and wherein said means for selective blocking and said grounding means are both actuated by said lever.

3. The fuel shutoff system of claim 2, wherein said engine further includes a throttle control, and wherein said throttle control comprises said lever.

4. The fuel shutoff system of claim 2, wherein said lever is one of a rotary motion lever and a push-pull motion lever.

5. The fuel shutoff system of claim 1, wherein said grounding means comprises:

an ignition; and an ignition grounding switch interconnected with said ignition, said grounding switch being selectively actuated by said control to ground ignition pulses of said engine.

6. The fuel shutoff system of claim 1, wherein said means for selectively blocking and said grounding means are actuated at substantially the same time by operation of said control.

7. A fuel shutoff system for an internal combustion engine, said engine having a passageway through which a gas passes to an intake valve of said engine and said engine having a throttle valve disposed in said passageway, said shutoff system comprising:

a blocking member, distinct from said throttle valve, disposed in said passageway;

a spacer section, forming a part of said passageway, said blocking member being disposed in said spacer section; and means for selectively positioning said blocking member in a first open position, and in a second closed position upon engine shutdown to substantially block the flow of said gas to said intake valve, said positioning means including a lever; and a cam interconnected between said blocking member and said lever;

whereby operation of said lever selectively moves said cam, said cam causing said blocking member to move between said first position and said second position.

8. The fuel shutoff system of claim 7, wherein said spacer section is disposed between a carburetor and an intake manifold of said engine.

9. The fuel shutoff system of claim 7, wherein said lever is a rotary motion lever, and whereby operation of said lever by a rotation of less than 90 degrees results in moving said blocking member about 90 degrees between said first position and said second position.

10. The fuel shutoff system of claim 7, wherein said lever is one of a rotary motion lever and a push-pull motion lever.

11. The fuel shutoff system of claim 7, wherein said fuel shutoff system further comprises:

means for grounding an ignition system of said engine;

wherein said means for selectively positioning and said grounding means are both actuated by operation of said lever.

12. The fuel shutoff system of claim 11, wherein said engine further includes a throttle control, and wherein said throttle control comprises said lever.

13. The fuel shutoff system of claim 11, wherein said lever is one of a rotary motion lever and a push-pull motion lever.

14. The fuel shutoff system of claim 11, wherein said grounding means comprises:

an ignition ground switch interconnected with said ignition system; and means for selectively actuating said ground switch to ground said ignition pulses upon operation of said lever.

15. The fuel shutoff system of claim 11, wherein said means for selectively positioning and said grounding means are actuated at substantially the same time by operation of said lever.

16. A fuel shutoff system for an internal combustion engine, said engine having a passageway through which a gas may pass to an intake valve of said engine and said engine having a throttle valve disposed in said passageway, said shutoff system comprising:

a blocking member, distinct from said throttle valve, disposed in said passageway;

a spacer section, forming a part of said passageway, said blocking member being disposed in said spacer section; and means for selectively positioning said blocking member in a first open position, and in a second closed position upon engine shutdown to substantially block the flow of said gas to said intake valve, said positioning means including a lever; and a bowden cable interconnected between said blocking member and said lever;

whereby operation of said lever selectively moves said blocking member between said first position and said second position.

17. The fuel shutoff system of claim 16, wherein said spacer section is disposed between a carburetor and an intake manifold of said engine.

18. The fuel shutoff system of claim 16, wherein said lever is one of a rotary motion lever and a push-pull motion lever.

19. The fuel shutoff system of claim 16, wherein said fuel shutoff system further comprises:

means for grounding an ignition system of said engine;

wherein said means for selectively positioning and said grounding means are both actuated by operation of said lever.

20. The fuel shutoff system of claim 19, wherein said engine further includes a throttle control, and wherein said throttle control comprises said lever.

21. The fuel shutoff system of claim 19, wherein said lever is one of a rotary motion lever and a push-pull motion lever.

22. The fuel shutoff system of claim 19, wherein said grounding means comprises:

an ignition ground switch interconnected with said ignition system; and means for selectively actuating said ground switch to ground said ignition pulses upon operation of said lever.

23. The fuel shutoff system of claim 19, wherein said means for selectively positioning and said grounding means are actuated at substantially the same time by operation of said lever.

24. A fuel shutoff system for an internal combustion engine, said engine having a passageway through which a gas may pass to an intake valve of said engine and said engine having a throttle valve disposed in said passageway, said shutoff system comprising:

a blocking member, distinct from said throttle valve, disposed in said passageway;

a spacer section, forming a part of said passageway, said blocking member being disposed in said spacer section;

means for selectively positioning said blocking member in a first open position, and in a second closed position upon engine shutdown to substantially block the flow of said gas to said intake valve;

a lever; and means for grounding an ignition system of said engine;

wherein said means for selectively positioning and said grounding means are both actuated by operation of said lever.

25. The fuel shutoff system of claim 24, wherein said engine further includes a throttle control, and wherein said throttle control comprises said lever.

26. The fuel shutoff system of claim 24, wherein said lever is one of a rotary motion lever and a push-pull motion lever.

27. The fuel shutoff system of claim 24, wherein said grounding means comprises:

an ignition ground switch interconnected with said ignition system; and means for selectively actuating said ground switch to ground said ignition pulses upon operation of said lever.

28. The fuel shutoff system of claim 24, wherein said means for selectively positioning and said grounding means are actuated at substantially the same time by operation of said lever.

* * * * *